US007806127B2

(12) United States Patent
Gibowski

(10) Patent No.: US 7,806,127 B2
(45) Date of Patent: Oct. 5, 2010

(54) SMELT SPOUT ENCLOSURE FOR CHEMICAL RECOVERY BOILERS

(75) Inventor: Steven R. Gibowski, Pensacola, FL (US)

(73) Assignee: ALSTOM Technology Ltd, Baden (CH)

( * ) Notice: Subject to any disclaimer, the term of this patent is extended or adjusted under 35 U.S.C. 154(b) by 341 days.

(21) Appl. No.: 11/536,887

(22) Filed: Sep. 29, 2006

(65) Prior Publication Data

US 2008/0079203 A1 Apr. 3, 2008

(51) Int. Cl.
*B08B 3/04* (2006.01)
*D21C 11/12* (2006.01)

(52) U.S. Cl. ..... 134/104.1; 162/30.1; 162/30.11

(58) Field of Classification Search ..... 134/104.1, 134/104.2, 104.3, 22.1, 22.11, 22.12, 166 R, 134/42; 162/30.1, 30.11, 239, 272; 266/196
See application file for complete search history.

(56) References Cited

U.S. PATENT DOCUMENTS

| | | | | |
|---|---|---|---|---|
| 2,967,758 | A | 1/1961 | Thorson | |
| 3,122,421 | A | 2/1964 | Gettle | |
| 4,421,596 | A | 12/1983 | Högberg | |
| 4,462,319 | A | 7/1984 | Larsen | |
| 4,659,020 | A | 4/1987 | Kutrow | |
| 4,761,204 | A * | 8/1988 | Kohl et al. | 162/30.1 |
| 5,123,836 | A * | 6/1992 | Yoneda et al. | 431/5 |
| 5,204,069 | A | 4/1993 | Paxton et al. | |
| 5,667,201 | A * | 9/1997 | Beveridge et al. | 266/196 |
| 5,976,319 | A * | 11/1999 | Paju et al. | 162/30.1 |
| 6,325,460 | B1 * | 12/2001 | Frederick | 299/95 |
| 2006/0021635 | A1 * | 2/2006 | Kupferberg | 134/22.1 |

FOREIGN PATENT DOCUMENTS

| | | | |
|---|---|---|---|
| EP | 1681512 A2 | | 7/2006 |
| JP | 52-114705 | * | 9/1977 |
| WO | WO 03/093747 | * | 11/2003 |

OTHER PUBLICATIONS

PCT International Search Report and The Written Opinion of the International Searching Authority dated Apr. 6, 2008—(PCT/US2007/077816).

* cited by examiner

*Primary Examiner*—Michael Kornakov
*Assistant Examiner*—Stephen Ko
(74) *Attorney, Agent, or Firm*—Lawrence P. Zale

(57) ABSTRACT

An enclosure for a smelt spout of a chemical recovery boiler comprises a skirt having a central region through which smelt flowing from the smelt spout falls into a dissolving tank. The central region is defined by a wall and has a trough disposed around its perimeter. The trough is supplied with a fluid that overflows the trough and flows downward across the wall toward the dissolving tank to clean and cool the skirt. The trough may have a depth substantially equal to the height of the skirt, and the fluid may include at least one of: water, weak wash, and green liquor. Water may be periodically supplied to the trough in lieu of the fluid to clean the trough. A nozzle system is configures to direct at least one shatter jet onto the smelt flowing from the smelt spout to break it up into smaller particles.

12 Claims, 5 Drawing Sheets

SMELT SPOUT ENCLOSURE FOR CHEMICAL RECOVERY BOILERS

BACKGROUND

Chemical recovery boilers perform two basic functions: burning organics to make steam for various mill processes and recovering the inorganic chemicals used in the pulping process. The processed inorganic chemicals or "smelt" from the recovery boiler are collected at the bottom of the furnace and are discharged through dedicated openings in the lower furnace into a main dissolving tank. The main dissolving tank is filled with waste water from a lime mud washing process, which is also known as weak wash. The molten smelt, with temperatures as high as 1500° F. must be broken into small droplets using jets of steam or weak wash before the molten smelt enters the main dissolving tank. If the smelt is not properly shattered, there can be an explosive reaction between the water in the weak wash in the dissolving tank. In the dissolving tank, the smelt is dissolved into either water, during start-up, or weak wash to produce green liquor.

There are two distinct methods for smelt to be collected and discharged from the lower furnace. A decanting hearth design is where the furnace bottom is flat and an inventory of smelt collects in the lower furnace. As the level rises the smelt flows into sloped discharged chutes, known as smelt spouts, to the shatter jets and dissolving tank. The second design has a sloped furnace floor where the smelt flows by gravity towards the smelt spouts. In either design, blockage of these spouts can require immediate corrective actions on the part of the outside operator. Typically a small percentage of the smelt freezes to the external surface of the water cooled trough due to cooling water supply temperatures being in the 150° F. to 180° F. range. This is common and is a form of protection for the metals used in the spout. However, the liquid level or tide line in the trough may also freeze due to ambient temperatures and tends to crust over blocking the free flow of smelt.

Normal operation of the spout enclosures requires routine observation and maintenance that includes manual manipulation of the smelt within the smelt spout using a long rod (known as "rodding") to insure smelt flow from the spout. Under normal operation, access door(s) on a spout enclosure are closed to keep the effects of tank drafts to a minimum and to prevent re-oxidization of the smelt flowing off of the spout. When the spout is rodded, the access doors are opened and several things occur. The uniformity of the stream of smelt flowing off of the spout is commonly disturbed due to the rodding and/or drafts induced by either the scrubber vent fan or the natural draft of the vent stack. This disturbed flow can negatively impact the effectiveness of the shatter jet spray which can result in either minor explosions from the dissolving tank or may deposit materials on the lower portions of the smelt spout enclosure. Other factors may also add to the building of smelt accumulations on the side walls of the smelt spout enclosures.

The use of fluid washing inside the smelt spout enclosures has been common over the last several decades to combat the accumulation of smelt on the side walls of the smelt spout enclosures. Such washing typically includes the use of a wash header placed around the perimeter of the enclosure at or slightly above the discharge trough of the spout. The header typically contains spray nozzles or holes drilled in the header and spaced uniformly around the perimeter to yield a uniform curtain of wash water that keeps the lower portion of the enclosure (known as the "skirt") wet and washed. The preferred cleaning medium is weak wash because its use does not disturb the mill's liquor cycle balance. However, the solids in the weak wash have a tendency to plug the holes in the wash header reducing the coverage and effectiveness of the washing system.

The operation and maintenance of the enclosure suffers when the skirt washing header and its nozzle(s) plug and materials are allowed to accumulate on skirt walls. Aside from the return of buildups to the unwashed area, several other issues tend to occur. The dry zone tends to have a higher temperature than the washed areas where thermal differential expansion buckles the skirt walls. This buckling disturbs the sheeting action of the original wash system and if allowed to continue, this area will not be properly washed again until the skirt walls are straightened. Another impact of this condition is that locally higher temperatures can accelerate corrosion in the skirt walls. Tramp air ensues and either distorts the flow of smelt from the spout which tends to re-oxidize the smelt (lowering the reduction efficiency) or can overload the capacity of the scrubber vent fan which may allow gases to escape the dissolving tank into the work environment.

SUMMARY

The above-described and other drawbacks and deficiencies of the prior art are overcome or alleviated by an enclosure for a smelt spout of a chemical recovery boiler. The enclosure comprises a skirt having a central region through which smelt flowing from the smelt spout falls in route to a dissolving tank. The central region is defined by a wall and has a trough disposed around its perimeter. The trough is supplied with a fluid that overflows the trough and flows downward across the wall toward the dissolving tank to clean and cool the central region of the skirt. The trough may have a depth substantially equal to the height of the skirt, and the fluid may include at least one of: water, weak wash, and green liquor.

In various embodiments, steam is periodically supplied to the trough to place sediment in the trough into suspension in the fluid. Where the fluid is weak wash or green liquor, water may be periodically supplied to the trough in lieu of the fluid to clean the trough.

In various embodiments, the enclosure is supported by the boiler such that the enclosure moves with the boiler as the boiler thermally expands. In such embodiments, the skirt protrudes into an extension attached to the main dissolving tank. A hood cover may be disposed above the smelt spout and attached to the skirt. The hood cover has at least one rodding door disposed thereon, a pair of shields disposed on opposite sides of the hood cover and extending above the hood cover; and a chain curtain extending between the pair of shields to deflect smelt particles ejected through the rodding doors.

In various embodiments, a primary nozzle system is attached to the hood cover and is configured to direct at least one shatter jet onto the smelt flowing from the smelt spout. A secondary nozzle system is attached to the extension and is configured to direct a plurality of interlaced shatter jets onto smelt within the extension.

In yet another aspect, a method of cleaning and cooling a skirt for a smelt spout enclosure of a chemical recovery boiler comprises: providing a flow of fluid to a trough disposed around an inner perimeter of the skirt, the fluid overflowing the trough and flowing downward across an interior wall of the skirt to clean and cool the interior wall. The trough may have a depth substantially equal to the height of the skirt, and the fluid may include at least one of: water, weak wash, and green liquor.

The method may further comprise: periodically supplying steam to the trough to place sediment in the trough into suspension in the fluid. Where the fluid is weak wash or green liquor, the method may further comprise periodically supplying water to the trough in lieu of weak wash to clean the trough.

In yet another aspect, an enclosure for a smelt spout of a chemical recovery boiler comprises: a skirt having a central region through which smelt flowing from the smelt spout falls in route to a dissolving tank; a hood cover disposed above the smelt spout and attached to the skirt; an extension attached to the main dissolving tank, the skirt protrudes into the extension; a primary nozzle system attached to the hood cover and configured to direct at least one shatter jet onto the smelt flowing from the smelt spout; and a secondary nozzle system attached to the extension and configured to direct a plurality of interlaced shatter jets onto smelt within the extension.

BRIEF DESCRIPTION OF THE DRAWINGS

Referring now to the drawings, wherein like items are numbered alike in the various Figures.

DETAILED DESCRIPTION

Figure 1:
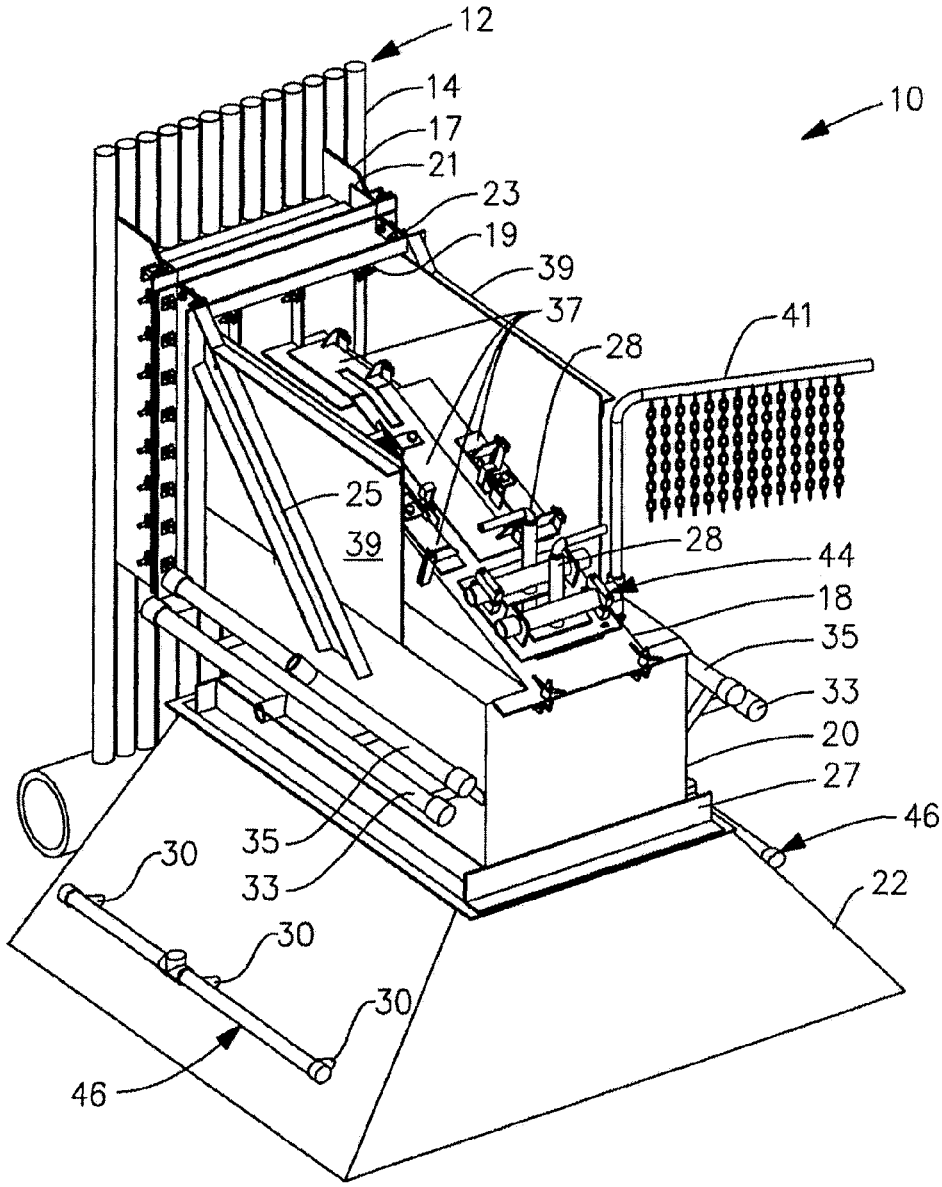
FIG. 1 is a perspective view of a smelt spout enclosure attached to a wall of a conventional chemical recovery boiler.
Figure 2:
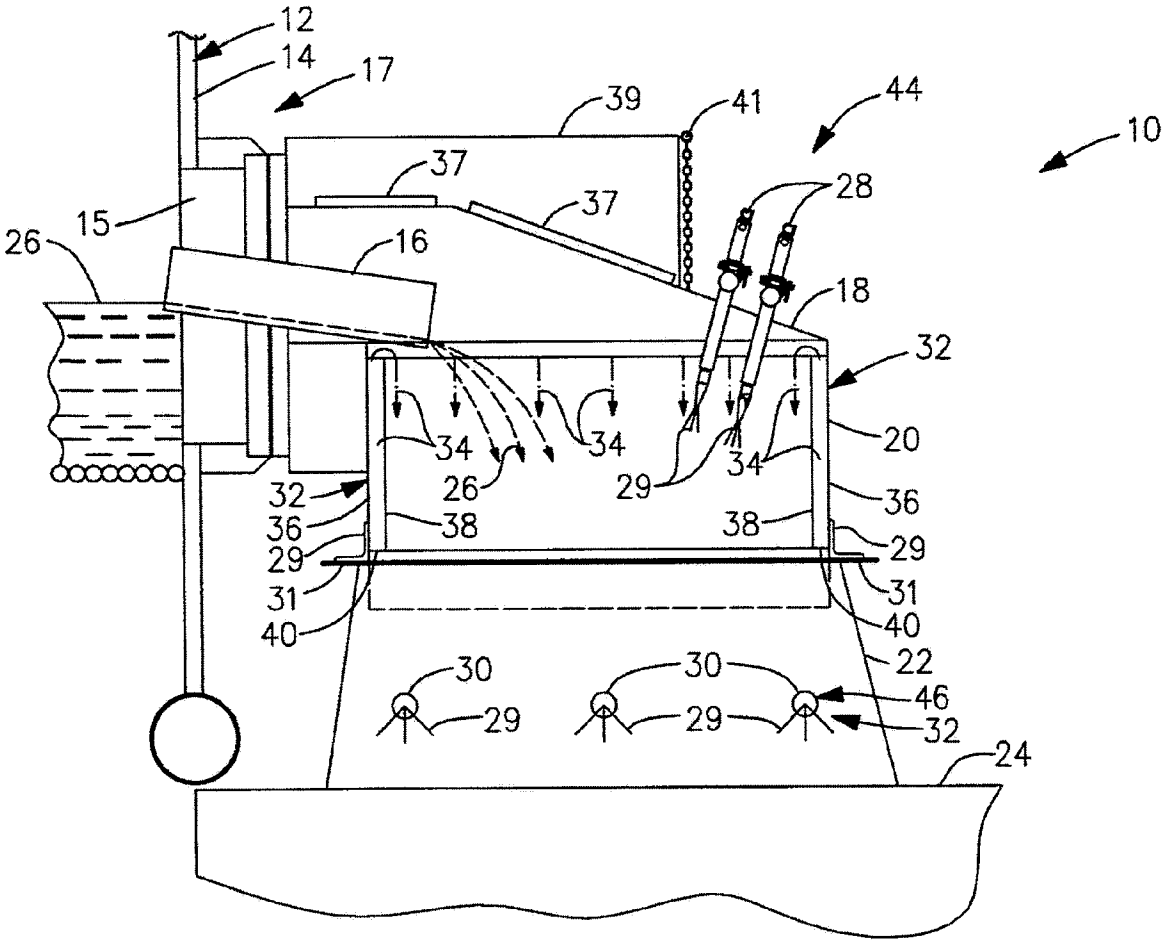
FIG. 2 is a simplified cross-sectional view of the smelt spout enclosure of FIG. 1.

FIG. 1 is a perspective view of a smelt spout enclosure 10 attached to a wall of a conventional chemical recovery boiler 12; and FIG. 2 is a simplified cross-sectional view of the smelt spout enclosure 10. Referring to FIGS. 1 and 2, the walls of the recovery boiler 12 are formed by water-cooled tubes 14, which are shaped to provide an opening 15 above the bottom of a furnace portion of the boiler 12. Extending through the opening 15 is a smelt spout 16. The portion of the smelt spout 16 extending outside the boiler 12 is surrounded by the enclosure 10 to prevent liquid and smelt splashes and exhaust gases from being discharged into the surrounding environment. The lower end of the enclosure 10 is disposed within an opening in an extension 22 of a dissolving tank 24.

The hot, fluid smelt 26 runs from the bottom of the furnace portion of the boiler 12 via the opening 15 to the smelt spout 16. The smelt 26 flows along the bottom of the spout 16 and falls from the free end of the spout 16 into the dissolving tank 24, where the smelt is dissolved into liquid. In order to breakup the fluid smelt into smaller drops before it reaches the dissolving tank 24, jets of steam 29 are directed to shatter (disrupt) the smelt flow using primary (upper) and secondary (lower) shatter jet nozzles 28 and 30, respectively. While only one smelt spout 16 and enclosure 10 is shown, it will be appreciated that a single boiler 12 may include a plurality (e.g., 2, 3, 4, 5, 6, etc.) of smelt spouts 16, each having its own enclosure 10, and each of the enclosures 10 may be connected to a single dissolving tank 24.

The smelt spout enclosure 10 includes of three main components: a frame portion 17, which attaches to the tubes 14 of the boiler 12; a hood cover 18, which is attached to the frame portion 17 by hinges 19; and a skirt 20 (also known as a doghouse) that attaches to the hood cover 18 and frame portion 17 and protrudes into the main dissolving tank extension 22. Each of these three main components may be bolted together and are removable to allow for the inspection, maintenance, and replacement of spout 16. The entire enclosure 10 may be fabricated from stainless steel to minimize corrosion.

The frame portion 17 includes a mounting frame 21, which is attached to the tubes 14 by welding or the like, and a support frame 23, which is bolted to the mounting frame 21 and which is hinged to the hood cover 18. The support frame 23 includes beams 25, which are attached to the skirt 20 to support the weight of the skirt 20. The entire enclosure 10 is supported by the boiler 12 and moves with the boiler 12 as it thermally expands.

As best seen in FIG. 2, the skirt 20 extends within an opening in the tank extension 22, which is rigidly attached to the dissolving tank 24. Clearance between the outer perimeter of the skirt 20 and tank extension 22 allow the skirt 20 to extend further into the tank extension (as indicated at 20') as the enclosure 10 moves due to expansion of the boiler 12. The tank extension 22 may be provided with a sliding seal 27 to minimize the potential for escaping gases and debris from the tank 24, while also minimizing air entering the tank 24, via the clearance opening between the outer perimeter of the skirt 20 and the tank extension 22. The sliding seal 27 comprises an "L" shaped bracket 29 that is loosely disposed around the outer perimeter of the skirt 20, and which rests on an upper flange 31 of the tank extension 22. The sliding seal 27 closes the opening between the outer perimeter of the skirt 20 and the tank extension 22 while still allowing the skirt 20 to move within the tank extension 22.

The hood cover 18 is hinged to the frame portion 17 and is attached to the skirt 20 by wingnuts or the like to allow quick access to the smelt spout 16. The hood cover 18 can be easily lifted out of the way or removed if needed. A number of rodding doors 37 are located at the top of the cover 18, and may be opened when spout 16 cleaning is required. Safety enhancements for the rodding process include side shields 39 installed to either side of the rodding doors 37 and a chain curtain 41. These two components help stop or deflect any smelt particles that may be ejected through the rodding doors 37 from contacting the operator. The chain curtain 41 is shown in FIG. 1 in the open position. During the rodding process, the chain curtain 41 would be closed such that the curtain 41 extends between the side shields 39 to deflect any smelt particles that may be ejected through the rodding doors 37. The chain curtain 41 may be self-closing such that it will be automatically swung to the closed position under the force of gravity, spring force, or the like, thus ensuring that the chain curtain 41 is maintained in a safe position.

The enclosure 10 is designed to use water, weak wash, or green liquor as a skirt washing medium, and effectively copes with various weak wash and green liquor densities and particulate matter in the washing medium. The skirt 20 includes a weir box (trough) 32 into which a flow of liquid 34, such as weak wash, water, or green liquor is provided by inlet manifolds 33. In the embodiment of FIG. 2, the trough 32 is formed between an outer wall 36 of the skirt 20, an inner wall 38 disposed within the outer wall 36 and offset therefrom, and a bottom wall 40 connecting the outer and inner walls 36, 38. Liquid 34 from the inlet manifolds 33 fills the trough 32, overflows the top of the trough 32, and flows downward across the inner surfaces of the skirt 20 (the inner surfaces of the inner wall 36), thus providing a uniform flow of liquid 34 to clean smelt from the inner surfaces of the skirt 20 and to cool the walls of the skirt 20. In the embodiment shown, the trough 32 has a depth substantially equal to the height of the skirt 20 to allow the liquid 34 in the trough 32 to provide additional cooling to the skirt 20. As will be described in further detail hereinafter, the trough 32 may be flushed automatically on a routine basis with steam or water via inlet manifolds 33 and 35 to insure proper cooling and cleaning properties.

Figure 4:
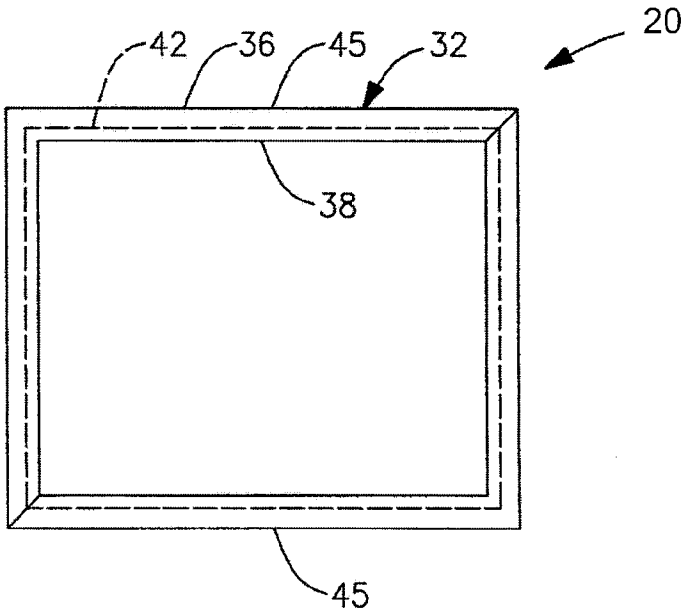
FIG. 4 is a top view of an alternative skirt of the smelt spout enclosure, including a trough formed therein.
Figure 3:
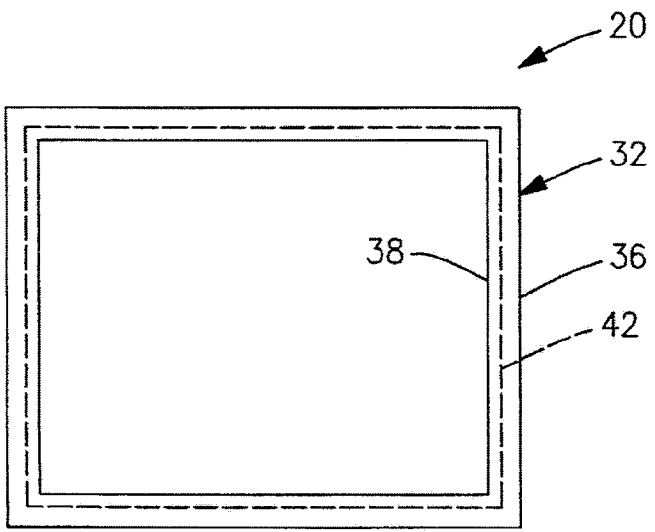
FIG. 3 is a top view of a skirt of the smelt spout enclosure, including a trough formed therein.

FIG. 3 depicts a simplified top view of the skirt 20 including the trough 32. As shown in FIG. 3, the trough 32 extends around the entire perimeter of the skirt 20, thus providing for uniform cleaning and cooling around the entire inner surface of the skirt 20. In the embodiment of FIG. 3 the trough 32 is formed as a single, uninterrupted channel. It will be appreciated, however, that the trough 32 may be formed by a plurality of trough sections 45, as shown in FIG. 4, which, when taken together form the trough 32 extending around the entire perimeter of the skirt 20. In any case, the trough 32 may include a cover, depicted in phantom at 42, which extends from the outer wall 36 toward the inner wall 38 to cover a portion of the gap between the two walls 36 and 38 for preventing smelt from entering into the trough 32 and for preventing fluid 34 from splashing upward from the trough 32 during flushing of the trough 32.

Figure 5:
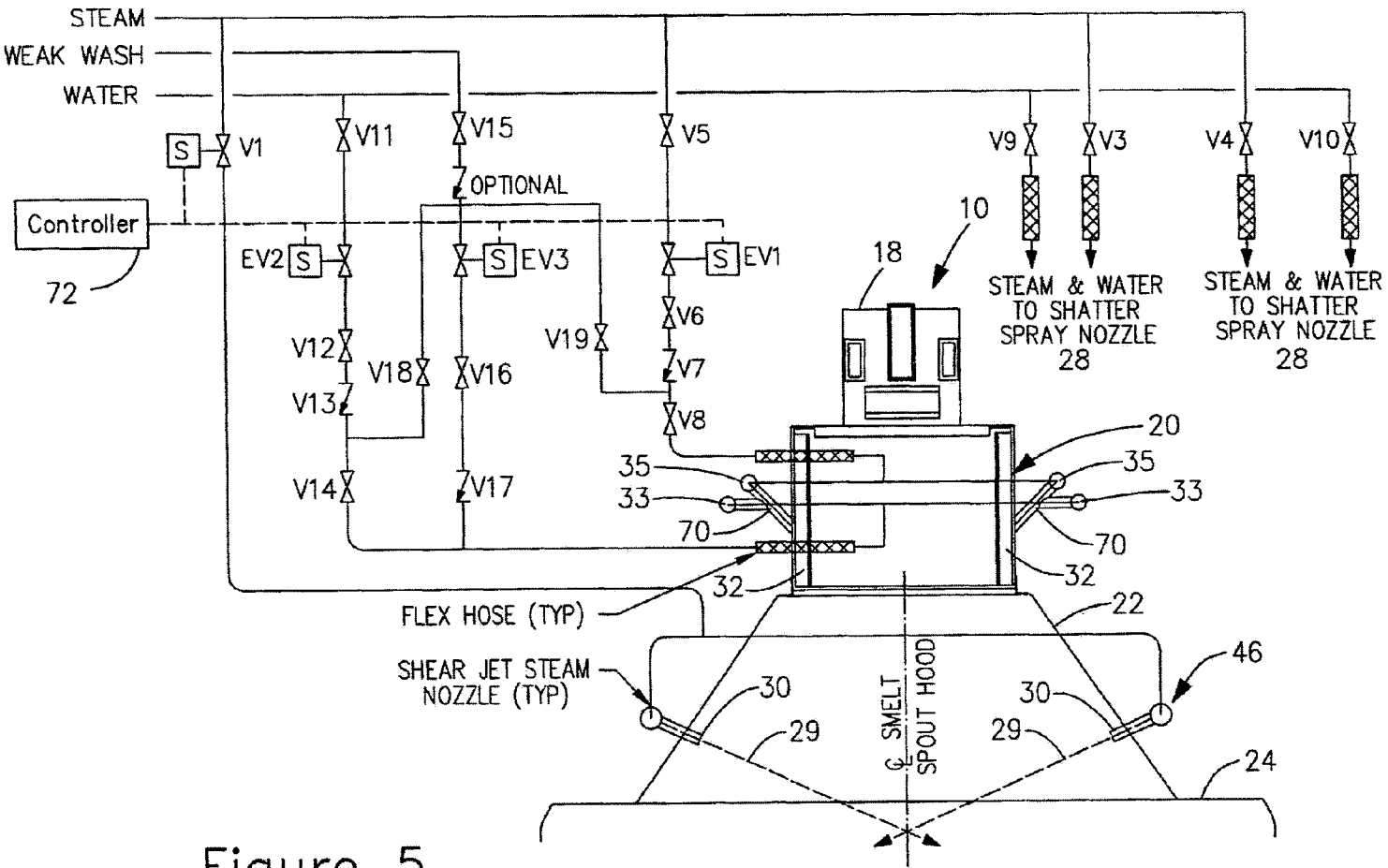
FIG. 5 is a schematic diagram of a piping system associated with the smelt spout enclosure.

FIG. 5 is a schematic diagram of a piping system associated with the smelt spout cover 10. As shown in FIG. 5, the manifolds 33 and 35 are in fluid communication with the trough 32 via "Y" junctions 70. Manifold 35 is in fluid communication with a supply of steam via valves V5, EV-1, V6, V7, V8. Manifold 33 is in fluid communication with a supply of weak wash (or green liquor) via valves V15, EV-3, V16, and V17. Manifold 33 may also receive a supply of water via valves V11, EV-2, V12, V13, and V14. Valves EV-1, EV-2, and EV-3 are solenoid valves, which receive operating signals from a controller 72. Controller 72 may be a programmable logic controller (PLC), distributed control system (DCS), computer, microprocessor, integrated circuit, digital circuit, analog circuit, timer, or the like, which is capable of controlling the operation of solenoid valves in response to user input, stored instructions, and the like. While each of the solenoid valves EV-1, EV-2, EV-3 are shown as being controlled by a single controller 72, it will be appreciated that each of these solenoid valves may be controlled by individual controllers, or may be operated locally or remotely by switch, or locally by hand.

The controller 72 is configured to control the solenoid valves EV-1, EV-2, EV-3 to provide two basic automatic modes of operation: "Normal Mode" and "Backup Water Mode", either of which may be selected by the operating personnel. When either of these two modes is selected for use, their functions may include the automatic "Weir Trough Flushing Mode" and "Water Flush Mode" for removal of any sediment from the weir trough 32 and associated weak wash supply piping. Furthermore, cleaning of the piping system and trough 32 may be performed by manually controlling the various valves in the system. For example, two crossover valves (V18 and V19) allow the weak wash line to be isolated (via V15) and cleaned with water and steam.

In Normal Mode, weak wash (or green liquor) is used as the cooling and washing medium for the skirt 20. During Normal Mode, a steady supply of weak wash is supplied to the trough 32 through valves V15, EV-3, V16, and V17, and water and steam line valves (EV-2 and EV-1, respectively) are closed. Weak wash flow is set using the manual valves (V15, and V17) to ensure that an even and consistent flow of weak wash is maintained at all times on the inside surface of the skirt 20.

When the system is first energized, a cycle timer in controller 72 is automatically started for the Weir Trough Flushing Mode and the Water Flush Mode. These cycle timers may stay active until the system is shut down, and their associated period and duration may be set by user-input. The Weir Trough Flushing Mode is activated periodically (e.g., every 20 minutes) for a predetermined duration (e.g., 20 seconds) to remove sediment and debris from the weir troughs 32. During the Weir Trough Flushing Mode, the controller 72 opens the steam solenoid valve EV-1 to allow steam to flow to the trough 32 via valves V5, EV-1, V6, V7, V8, and the manifold 35. The weak wash line (V15, EV-3, V16, and V17) is kept open during this sequence. This steam provides a motive force for agitation in the trough 32, which places any sediment into suspension. The steam also supplies a degree of thermal shock to the trough 32 and any sediment adhered thereto, contributing to placing any solids adhered to the trough 32 into suspension. The continuous flow of weak wash carries the debris over the trough 32 into the dissolving tank 24. After the predetermined duration (e.g., the 20 seconds), the steam solenoid valve EV-1 is shut, and the system returns to the Normal Mode.

The Water Flush Mode is activated at a period that is typically greater than the Weir Trough Flushing Mode (e.g., every 72 hours) and for a longer duration (e.g., 20 minutes) to send water through the troughs 32 and associated supply piping to clean these portions of the system. During the Water Flush Mode, the controller 72 opens the water solenoid valve EV-2 to allow fresh water to flow to the trough 32 via valves V11, EV-2, V12, V13, V14, and the manifold 35. During this sequence, the weak wash solenoid valve EV-3 is closed, and the steam section solenoid valve EV-1 may be opened periodically (e.g., every 2 minutes) for a brief period of time (e.g., 20 seconds). After the predetermined duration (e.g., 20 minutes), the Water Flush Mode ends and the system is returned to the Normal Mode.

In the Backup Water Mode, the water solenoid valve EV-2 is opened to allow water to flow to the trough 32 via valves V11, EV-2, V12, V13, V14, and the manifold 35. During this sequence, the weak wash line solenoid valve EV-3 is closed, and fresh water is used as the cooling and washing medium for the skirt 20. Both the Weir Trough Flushing Mode and the Water Flush Mode are operable during the Backup Water Mode.

Referring again to FIGS. 1 and 2, the enclosure 10 includes two shatter jet nozzle systems: a primary (upper) nozzle system 44, and a secondary (lower) nozzle system 46. The primary nozzle system 44 includes two nozzles 28 attached to the hood cover 18, and the secondary nozzle system 46 includes a plurality of nozzles 30 attached to the tank extension 22.

Figure 6:
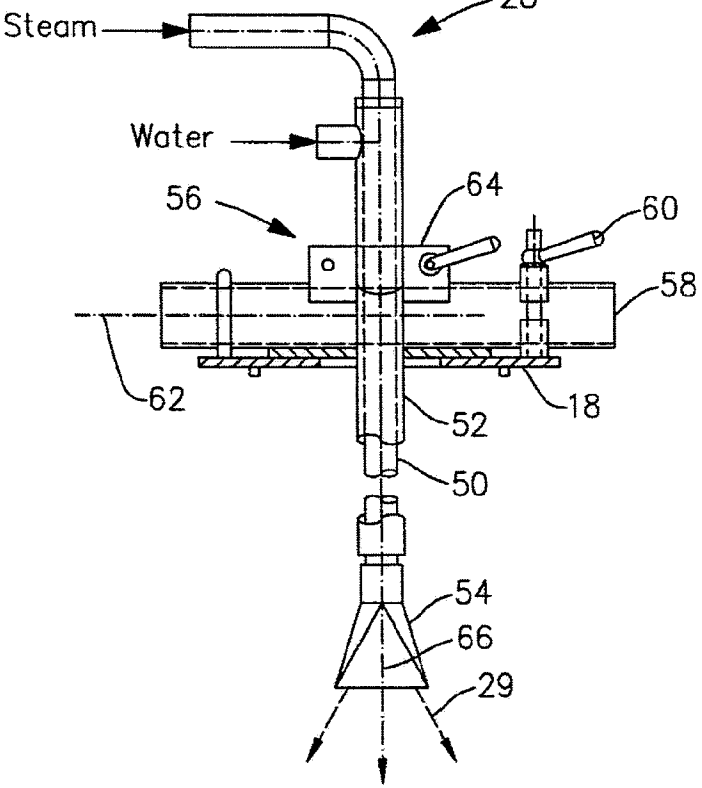
FIG. 6 is an elevation view of a shatter jet nozzle associated with the smelt spout enclosure.

FIG. 6 depicts an example of a nozzle 28 for use in the primary nozzle system 44. While only one nozzle 28 is shown, it will be appreciated that both nozzles 28 in the primary nozzle system 44 may be configured in a similar manner. In the embodiment shown, the nozzle 28 comprises a pair of concentric pipes 50 and 52. The inner pipe 50 accepts a flow of wash water, and the annulus between the inner pipe 50 and an outer pipe 52 accepts a flow of steam. The tip 54 of the nozzle may have a flattened cone ("duckbill") shape. As shown in FIG. 5, the flow of steam and water to the nozzle 28 are controlled by separate valves, where the water valves are depicted at V9 and V10 and steam valves are depicted at V3 and V4. Each valve V3 and V4 allows the operator to adjust the steam flow from one nozzle 28 as necessary to meet smelt flow conditions from the smelt spout 16 (FIG. 2). Each valve V9 and V10 allows the operator to quench and clean one nozzle 28 with wash water, either on an as needed or continuous basis, when fouling and build-up of smelt occurs on the nozzle 28.

Referring again to FIG. 6, the nozzle 28 extends through an aperture in the hood cover 18 and is mounted thereto by a clamp system 56, which allows for adjustment of the nozzle 28 to direct the shattering steam jets 29 for changing smelt run-off flow conditions from the smelt spout 16 (FIG. 2). The clamp system 56 includes a cylindrical support 58, which is pivotally mounted to the hood cover 18 by a first clamp 60. Attached to the cylindrical support 58 is a second clamp 64, which secures the nozzle 28 to the cylindrical support 58.

Releasing the first clamp 60 allows the cylindrical support 58 to pivot about its longitudinal axis 62, thereby allowing an operator to adjust the angle of the shattering steam jet 29. Also, the operator may move cylindrical support 58 in a direction along its longitudinal axis 62 to adjust the location of the shattering steam jet 29 in the direction of the longitudinal axis 62. By releasing the second clamp 64, the operator is able to move the nozzle 28 in the direction of its longitudinal axis 66 and to pivot the nozzle 28 about its longitudinal axis 66. The operator may tighten clamps 60 and 64 to secure the nozzle 28 in-place. Thus, a full range of nozzle 28 adjustment is possible to ensure good intersection of the shatter steam jet 29 with smelt flow from the spout 16 over a wide range of operating conditions and varying streams of smelt flow.

Figure 7:
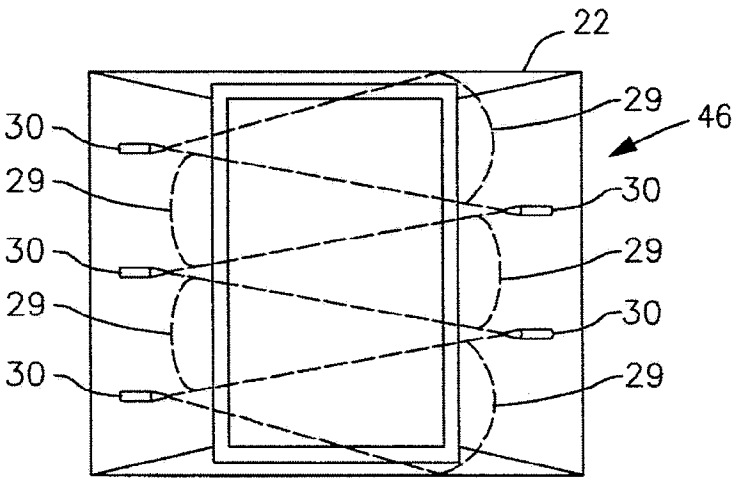
FIG. 7 is a bottom view of a dissolving tank skirt including a secondary shatter jet system.

Referring to FIGS. 5 and 7, the secondary (lower) nozzle system 46 includes a plurality of steam nozzles 30 attached to the tank extension 22. These nozzles 30 are positioned on opposite sides of the tank extension 22 on a common horizontal plane, and are offset from each other such that the generally conical or flattened-conical shatter steam jets 29 created by the nozzles 30 are interlaced, as depicted in FIG. 7. By being "interlaced" it is meant that a portion of each jet 29 intersects a portion of at least one opposing one jet 29. The shatter steam jets 29 may be angled downward, as depicted in FIG. 5. The interlaced pattern of the shatter steam jets 29 created by the nozzles 30 provides a "shearing" action between the jets 29. The shearing action is believed to enhance shattering of the smelt stream to insure complete break-up of the smelt stream before reaching the liquid level within the main dissolving tank 24. The shearing force is believed to shred any heavy flows of smelt into smaller, safer particles while directing them below the top of the tank 24. In addition, the negative slope of the tank extension 22 walls helps to prevent smelt from adhering to the walls of the tank extension 22. Steam to the secondary nozzle system 46 is controlled by solenoid valve V1, which may be manually or automatically activated. For example, the controller 72 may activate solenoid valve V1 periodically or when abnormal smelt flows are encountered. For example, the controller 72 may actuate valve V1 in response to acoustic signals caused by the reaction between the smelt and the liquid in the main dissolving tank 24. Valve V1 may also be manually or automatically actuated when operators are rodding out the smelt spout 16 (FIG. 2).

The smelt spout enclosure 10 described herein includes various features that reduce overall maintenance costs, reduce online operating maintenance of the enclosure 10 and enhance operator safety. For example, the weak wash cooled and cleaned skirt provides an effective system for online cleaning of the smelt spout enclosure that reduces on and off line maintenance requirements while enhancing safety. The automated cleaning cycles insure steady weir flows of weak wash and avoid plugging issues typically associated with weak wash header systems, thereby keeping the skirt clean, cool and straight. The primary steam shatter jets and independent, interlaced secondary shatter jets provide ample energy to shatter extreme smelt flows while complimenting other system design features that help protect auxiliary equipment and operating personnel.

Although the invention has been described and illustrated with respect to exemplary embodiments thereof, it should be understood by those skilled in the art that the foregoing and various other changes, omissions and additions may be made therein and thereto, without parting from the spirit and scope of the present invention. Accordingly, other embodiments are within the scope of the following claims.

What is claimed is:

1. An enclosure for a smelt spout of a chemical recovery boiler, the enclosure comprising:

a hood cover disposed above the smelt spout;

an extension enclosing a first central region through which smelt flowing from the smelt spout falls in route to a dissolving tank;

a double-walled skirt having a height extending between the hood cover and the extension along a perimeter inside of the extension, the skirt enclosing a second central region through which smelt flowing from the smelt spout falls in route to a dissolving tank, the skirt comprised of an outer wall enclosing an inner wall to define a trough between the walls, wherein the trough is filled with a fluid having a depth substantially equal to the entire height of the skirt, the trough and fluid adapted to cool the skirt, a fluid source coupled to the trough for supplying fluid to the trough;

such that fluid overflows the trough and flows downward substantially evenly across the inner wall toward the dissolving tank to clean and cool the inner wall of the skirt;

a steam source coupled to the trough, adapted to supply steam to the trough for cleaning out the trough; and a controller adapted to control the, fluid source and the steam source according to predetermined sequences.

2. The enclosure of claim 1, wherein the fluid includes at least one of: water, weak wash, and green liquor.

3. The enclosure of claim 1, wherein steam is periodically supplied to the trough to place sediment in the trough into suspension in the fluid.

4. The enclosure of claim 1, wherein the fluid is weak wash or green liquor; and water is periodically supplied to the trough in lieu of the fluid to clean the trough.

5. The enclosure of claim 1, wherein the enclosure is supported by the boiler such that the enclosure moves with the boiler as the boiler thermally expands, and wherein the skirt is slidingly connected to, and protrudes into the extension, and the extension is attached to the dissolving tank.

6. The enclosure of claim 1, further comprising:

at least one rodding door disposed on the hood cover;

a pair of shields disposed on opposite sides of the hood cover and extending above the hood cover; and a chain curtain extending between the pair of shields to deflect smelt particles ejected through the rodding doors.

7. The enclosure of claim 1, wherein:

the hood cover is attached to the skirt;

the extension is attached to the dissolving tank, and the skirt is slidingly attached to, and protrudes into the extension.

8. An enclosure for a smelt spout of a chemical recovery boiler, the enclosure comprising:

a double walled skirt having predetermined height, and a central region through which smelt flowing from the smelt spout falls in route to a dissolving tank;

a hood cover disposed above the smelt spout and attached to the skirt;

an extension attached to the dissolving tank, the skirt is slidingly attached to, and protrudes into the extension;

a primary nozzle system attached to the hood cover and configured to direct at least one shatter jet onto the smelt flowing from the smelt spout; and wherein the double walled skirt is further comprised of an inner wall and an outer wall defining a trough disposed between the walls filled with a fluid acting to absorb heat from the walls, the trough having a depth substantially equal to a predetermined height of the double walled skirt, a fluid source coupled to the trough being for supplying a flow fluid that overflows the inner wall and flows downward across the inner wall of the double walled skirt toward the dissolving tank to clean and cool the inner wall of the skirt; and a steam source coupled to the trough adapted to cleaning the trough; and a controller adapted to control the fluid source and the steam source according to predetermined sequences.

9. The enclosure of claim 8, further comprising:

at least one rodding door disposed in the hood cover;

a pair of shields disposed on each side of the hood cover and extending above the hood cover; and a chain curtain extending between the pair of shields to deflect smelt particles ejected through the rodding doors.

10. The enclosure of claim 1 further comprising:

a primary nozzle system attached to the hood cover and configured to direct at least one shatter jet onto the smelt flowing from the smelt spout.

11. The enclosure of claim 10 further comprising:

a secondary nozzle system attached to the extension and configured to direct a plurality of interlaced shatter jets onto the smelt within the extension.

12. The enclosure of claim 8, further comprising:

a secondary nozzle system attached to the extension and configured to direct a plurality of interlaced shatter jets onto the smelt within the extension.

* * * * *